US009533212B2

(12) United States Patent
Martinez

(10) Patent No.: US 9,533,212 B2
(45) Date of Patent: Jan. 3, 2017

(54) GOLF TRAINING DEVICE

(71) Applicant: Thomas W. Martinez, Cheshire, CT (US)

(72) Inventor: Thomas W. Martinez, Cheshire, CT (US)

( * ) Notice: Subject to any disclaimer, the term of this patent is extended or adjusted under 35 U.S.C. 154(b) by 0 days.

(21) Appl. No.: 14/706,280

(22) Filed: May 7, 2015

(65) Prior Publication Data

US 2015/0321066 A1 Nov. 12, 2015

Related U.S. Application Data

(60) Provisional application No. 61/989,655, filed on May 7, 2014.

(51) Int. Cl.

| | |
|---|---|
| ***A63B 69/36*** | (2006.01) |
| ***A63B 69/00*** | (2006.01) |
| *A63B 71/06* | (2006.01) |

(52) U.S. Cl.

CPC ..... *A63B 69/3632* (2013.01); *A63B 69/0057* (2013.01); *A63B 69/36* (2013.01); *A63B 69/3623* (2013.01); *A63B 2071/0655* (2013.01); *A63B 2208/0204* (2013.01); *A63B 2243/0029* (2013.01)

(58) Field of Classification Search

USPC ..... 473/207, 212, 213, 226, 227, 275, 276

See application file for complete search history.

(56) References Cited

U.S. PATENT DOCUMENTS

| | | | | |
|---|---|---|---|---|
| 4,145,054 | A | 3/1979 | Stewart | |
| 4,170,356 | A | 10/1979 | Banks | |
| 4,582,325 | A | 4/1986 | Yuhara | |
| 4,595,204 | A | 6/1986 | Patterson | |
| 4,693,479 | A | 9/1987 | McGwire | |
| 4,709,925 | A * | 12/1987 | Gatlin | A63B 69/38 473/463 |
| 4,781,382 | A * | 11/1988 | Hargraves | A63B 69/3685 473/227 |
| 4,913,441 | A | 4/1990 | Freer | |
| 5,423,536 | A * | 6/1995 | Brown | A63B 53/14 473/300 |
| 6,656,056 | B1 * | 12/2003 | Leonard | A63B 57/00 473/212 |
| 6,939,243 | B1 * | 9/2005 | Mitchell | A63B 69/0059 473/227 |

(Continued)

*Primary Examiner* — Nini Legesse

(74) *Attorney, Agent, or Firm* — Bachman & LaPointe, P.C.

(57) ABSTRACT

A golf training device comprising a body having a cylinder section including a first end and a second end opposite the first end. The cylinder section defines an interior portion extending from the first end to the second end. A flange section is coupled to the cylinder section proximate the second end. An edge is formed on a perimeter of the disc. A receiver is formed in the interior portion proximate the first end of the cylinder section. The receiver is configured to receive an end of a golf club grip. The interior portion is configured to contact the golf club grip in a fixed position. The edge portion configured to contact a forearm such that the forearm and a centerline of the golf club form an alignment angle. The alignment angle orients the golfers hands, wrist and forearms with a centerline of a golf club shaft.

4 Claims, 5 Drawing Sheets

(56) References Cited

U.S. PATENT DOCUMENTS

| | | | | |
|---|---|---|---|---|
| 7,611,421 | B2 * | 11/2009 | Brewer | A63B 55/10 473/282 |
| 7,931,541 | B2 * | 4/2011 | Rhodes | A63B 69/3632 473/201 |
| 8,216,079 | B1 * | 7/2012 | Brunetti | A63B 69/36 473/206 |
| 8,485,914 | B2 | 7/2013 | Martinez | |
| 2003/0083142 | A1 * | 5/2003 | Nam | A63B 53/14 473/286 |

* cited by examiner

GOLF TRAINING DEVICE

BACKGROUND

The present disclosure is directed to a golf training aid attachable to the grip end of a golf club shaft.

This invention relates to a training device for improving a golf swing and more particularly, provides a golf swing training device which employs a circular disc shaped guide attached at the grip end of the club maintain the plane of the golfer's swing and provide feedback to the golfer relating to his golf swing. The training device is suitable for training in the proper swing both for so called "woods" or distance clubs, "irons," and "wedges."

The golf swing is a complicated movement to execute properly through the sequences of the backswing, downswing and follow-through. Some of the factors that contribute to an improper golf swing are improper stance or positioning relative to the golf ball to be struck, improper pivoting, and improper positioning of the hands and elbows during the golf swing. An excellent discussion of the difficulties of the golf swing that needs to be corrected in order to achieve a proper golf swing consistently is provided in U.S. Pat. Nos. 4,145,054, 4,170,356, 4,582,325, 4,595,204, 4,693,479 and 4,913,441.

In U.S. Pat. No. 4,693,479, the golf swing training device 14 provides a visual indication of the position of the golf club during the backswing and downswing by sighting on the golf ball and the surface or area immediately surrounding the golf ball. The device 14 employs a light source mounted to the golf grip to provide a light beam that can track the path of the club head during the swing while the golfer, hopefully, keeps his head focused on the ball.

In U.S. Pat. No. 4,913,441, the complex flight of the golf ball hit by a golf club is explained. The correct of the positioning of the swing plane of the golf club along what is referred as "the target line" is essential in order to attain the desired direction and distance of the ball from the golf swing. In this patent, a laser light source is provided in the golf grip which projects a light beam out of the top of the golf grip to track the swing of the training device and provide feedback to the golfer relating to his swing.

In U.S. Pat. Nos. 4,145,054, 4,170,356 and 4,582,325, mechanical implements are attached to the golf club for teaching proper swing of the club.

In U.S. Pat. No. 4,595,204, the training device 21 employs a golf club 25 having a grip or handle over which an extension tube 35 is fitted. The extension tube 35 has a socket into which a centering pin is fitted for proper attachment of the extension tube. The golf club 25 has a club head that is intended to strike a ball on the downswing of the club 25. The length of the extension remains constant regardless of the length of the club 25 which may vary. The club 25 is a hollow plastic member. The free end of the extension tube has no indication means relating to achieving a proper golf swing.

The U.S. Pat. No. 8,485,914 describes a golf-training device configured to prevent the improper movement of the hands and wrists relative to the golf club during a golf swing. The content of this patent is incorporated by reference herein.

The training club embodying the invention overcomes the problems attendant the use of a light source in the golf club and the use of mechanical attachments which are cumber some and subject to distortions and damage during use and/or improper storage thereof. The use of a light source raises problems with respect to breakage when the club strikes the ball an the ground during a golf swing. The requirement for replacement of batteries also is a disadvantage. The devices using a light source tend to be relatively expensive also. Likewise, the use of special mechanical attachments can be expensive.

SUMMARY

In accordance with the present disclosure, there is provided a golf training device comprising a body having a cylinder section including a first end and a second end opposite the first end. The cylinder section defines an interior portion extending from the first end to the second end. A flange section is coupled to the cylinder section proximate the second end. The flange section is configured as a disc extending radially outward from a centerline of the cylinder section a predetermined diameter. An edge is formed on a perimeter of the disc. A receiver is formed in the interior portion proximate the first end of the cylinder section. The receiver is configured to receive an end of a golf club grip. The interior portion is configured to contact the golf club grip in a fixed position. The edge portion is configured to contact a forearm such that the forearm and a centerline of the golf club form an alignment angle. The alignment angle orients the golfers hands, wrist and forearms with a centerline of a golf club shaft.

In another and alternative embodiment, the alignment angle is about 36 degrees.

In another and alternative embodiment, the cylinder section is removable from said golf club grip.

In another and alternative embodiment, the flange section includes a disc shape with a thickness sufficient to maintain a planar shape that can yield and flex under sufficient force to provide a supple feel against the arm of the golfer.

In another and alternative embodiment, the diameter may be sized differently to produce a variety of alignment angles.

In accordance with the present disclosure, there is provided a method of using a golf training device comprises attaching the golf training device to a golf club grip; gripping the golf club; contacting an edge of the golf training device with a forearm; aligning a centerline of the golf club with the forearm; forming and alignment angle, wherein the alignment angle orients a golfers hands, wrist and forearm with a centerline of a golf club shaft.

In another and alternative embodiment the method includes indicating an improper alignment angle, wherein the edge of the golf training device no longer contacts the forearm.

In another and alternative embodiment the method includes varying the alignment angle, wherein a diameter of a flange section of the golf training device is changed, to result in a different alignment angle.

Other details of the golf training aid are set forth in the following detailed description and the accompanying drawings wherein like reference numerals depict like elements.

DETAILED DESCRIPTION

Figure 1:
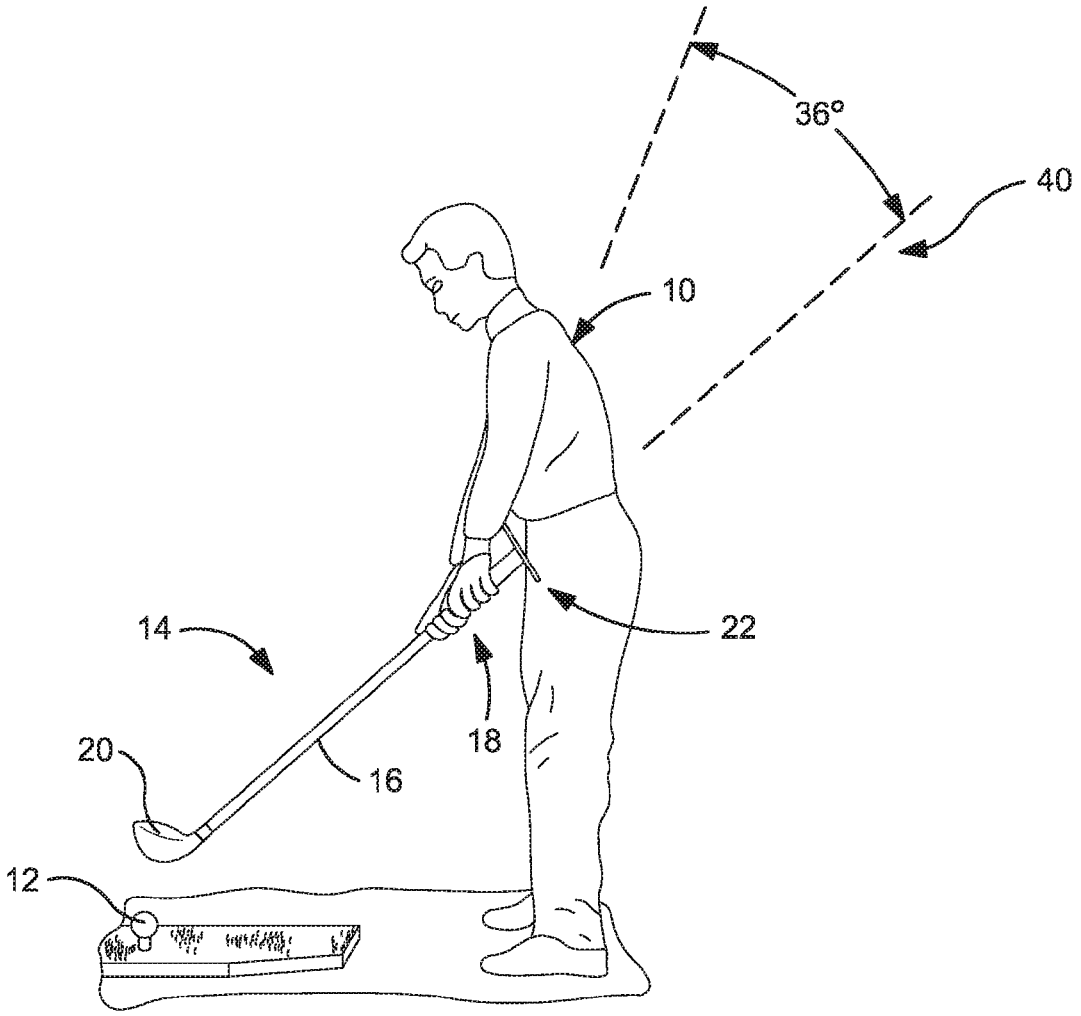
FIG. 1 is a schematic representation of a golfer using the inventive training device.

Referring now to FIG. 1, there is illustrated a golfer 10 in a standard golf stance addressing a golf ball 12. The golfer 10 is holding a golf club 14 having a shaft 16 and grip 18 affixed over an end of the shaft opposite the club head 20.

A golf swing training aid or simply training device 22 is attachable over the grip 18 of the shaft 16. The training device 22 is located opposite the club head 20 on the shaft 16. The training device 22 can be press fit onto the golf club grip 18 for any type of golf club 14, such as a driver, a wedge, or any of the irons.

Figure 2:
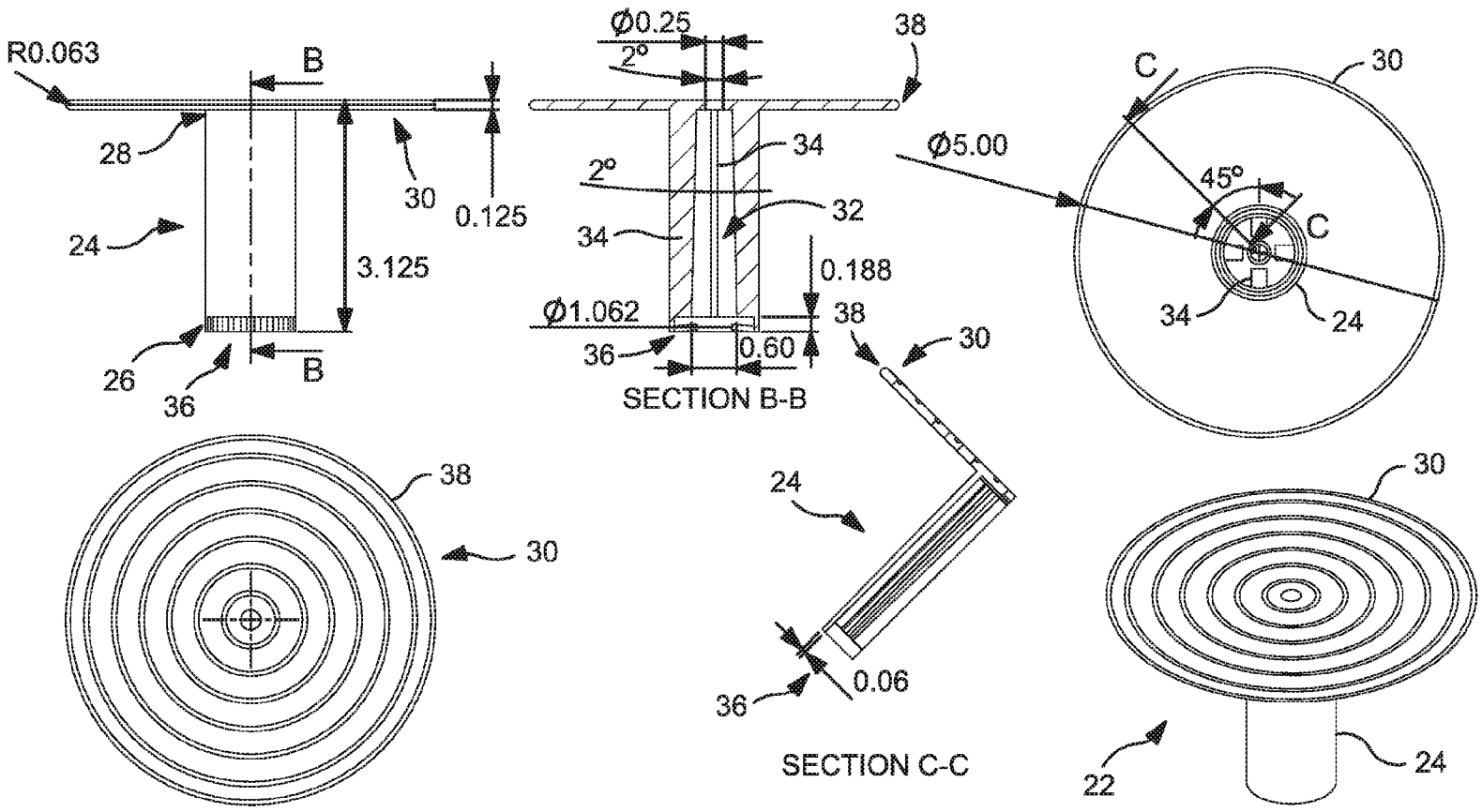
FIG. 2 is a multi-view drawing of the inventive training device.

Referring also to FIG. 2, the training device 22 can be made into a body as a one-piece construction of for example a molded rubber, or other suitable material. The training device 22 can include a cylinder section 24 having a first end 26 and a second end 28 opposite thereof. A flange section 30 is coupled to the cylinder section 24 proximate the second end 28. The cylinder section 24 defines an interior portion 32 extending from the first end 26 up to the flange section 30. The interior portion 32 is open proximate the first end 26 and configured to receive the grip 18 of the golf club 14 inserted into the interior portion 32. The interior portion 32 includes fins or rib members 34 that extend into the interior portion 32 forming part of the cylinder section 24. The rib members 34 are configured to receive the grip 18 and provide a snug friction fit with the grip 18. The rib members 34 may have a tapered profile such that the diameter of the interior portion 32 is larger proximate the first end 26 and gradually smaller proximate the second end 28. The rib members 34 can be resilient and flex to accommodate the insertion of the grip 18.

The interior portion 32 includes a receiver 36 defined by the cylinder section 24 and rib members 34. The receiver 36 is proximate the first end 26 and configured as a cylindrical space shaped to receive the grip 18. In exemplary embodiments, the receiver 36 can be dimensioned to snugly fit over the but end of the golf club grip 18 for any variety of grip 18 sizes, for example an adult man size grip, an adult woman size grip, or even a child size grip, and varieties in between depending on the custom sizes fashioned for golf club grips 18.

The flange section 30 can be formed of a similar material to the cylinder section 24. The flange section 30 is shaped as a disc extending radially outward from a central axis or centerline 38 of the cylinder section. The flange section 30 includes a disc shape with a thickness sufficient to maintain a planar shape, yet yield and flex under sufficient force, so as to provide a supple feel against the arm of a golfer 10. The flange section 30 has a diameter of 5 inches in an exemplary embodiment. The flange section 30 includes an outer diameter edge 40 with a rounded profile. The edge 40 is distal from the centerline 38 of the cylinder section 24. The edge 40 is configured to provide a tactile sensation when touching the forearm of the golfer 10.

Figure 3:
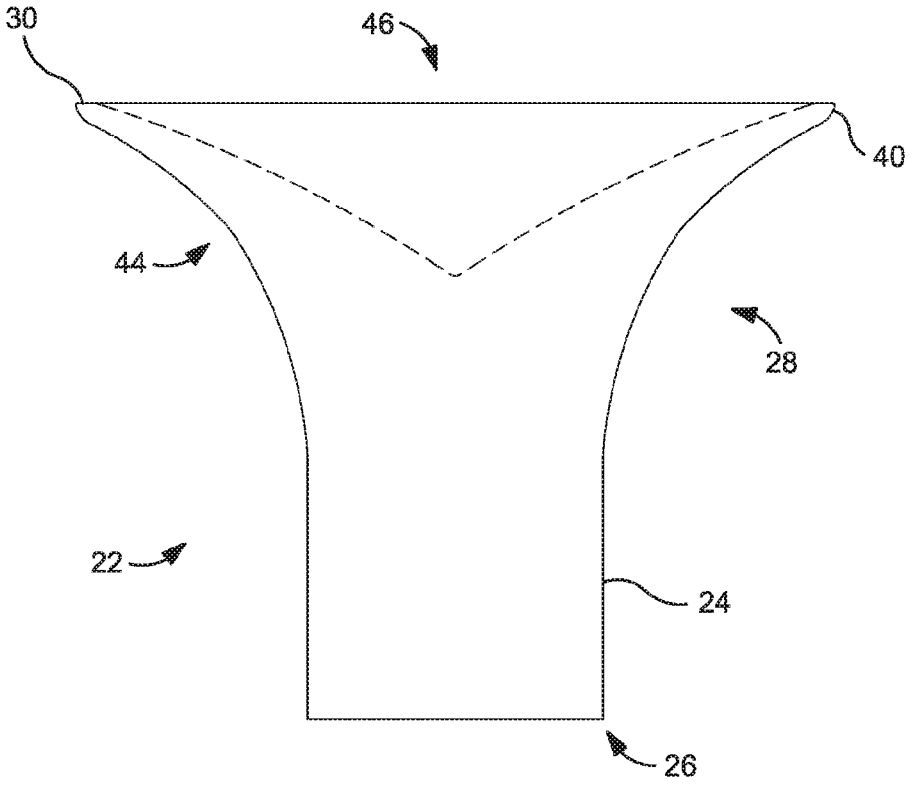
FIG. 3 is a side view and an alternative embodiment of the inventive training device.
Figure 4:
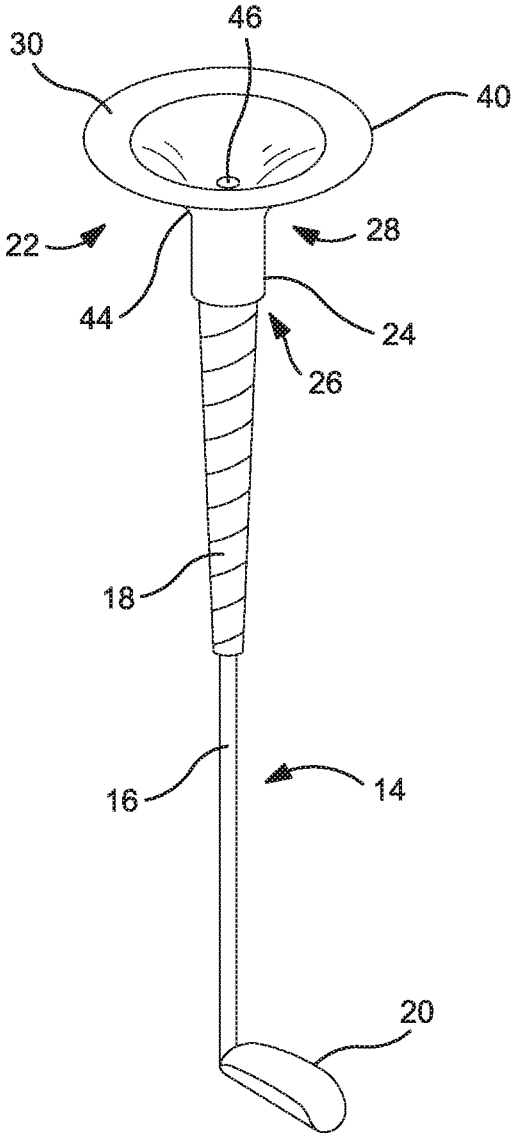
FIG. 4 is a perspective view of and alternative embodiment of the inventive training device on a golf club.
Figure 5:
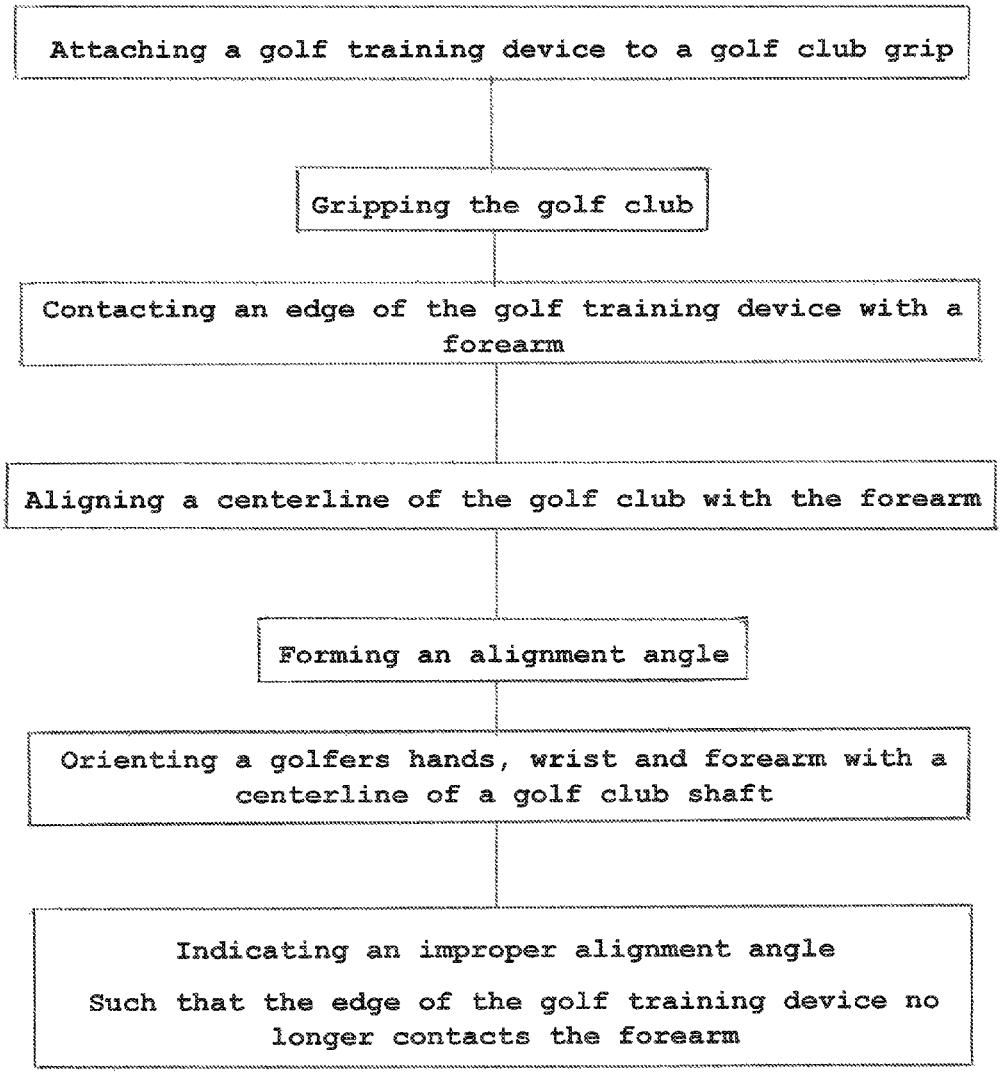
FIG. 5 is an exemplary process flow chart.

Referring also to FIG. 3 and FIG. 4, an alternative embodiment is shown. The training device 22 can include a fillet, or radius 44 extending between the flange section 30 and the cylinder section 24. The fillet 44 can extend at a gradual slope from the cylinder section 24 outward toward the outer diameter edge 40. The flange section 30 can also include a cavity 46 formed in the flange section 30 proximate the second end 28. The cavity 46 can be a conical shape.

The diameter of (5) five inches of the flange section 30 is configured to create the proper orientation of the golf club relative to the golfer's arms. The flange section outer diameter edge 40 is configured to touch the forearm of the golfer 10 when the golfer 10 has grasped the club grip 18 in the proper fashion in preparation for swinging the golf club 14. When the proper hand grasp is made with the grip 18 of the golf club 14, the edge 40 of the training device 22 touches the forearm of the golfer 10 creating an alignment of the golfer's arms, forearms, wrist and hands, to a centerline 42 of the shaft 16. The alignment of the shaft 16 to the wrist/forearm should be an angle of about 36 degrees. This angle is measured from the centerline 42 of the golf club shaft 16 to the back of the lead forearm of the golfer 10. However, the diameter may be sized differently to produce a different wrist/forearm angle to golf club shaft centerline 42. In an exemplary embodiment, the central axis 38 of the training device 22 aligns with the golf club shaft 16 centerline 42.

There has been provided a golf-training device that attaches and detaches to/from the grip end of a golf club. The device can simply be press fit on the grip. The training device provides a tactile indication against the forearm of the golfer enabling the proper alignment of the golf club shaft with the wrist and forearm of the golfer. The training device encourages a one-piece take away in the golf swing. The device is light-weight, durable, weatherproof and has an ease of use unparalleled in similar golf aids. While the training device has been described in the context of specific embodiments thereof, other unforeseen alternatives, modifications, and variations may become apparent to those skilled in the art having read the foregoing description. Accordingly, it is intended to embrace those alternatives, modifications, and variations that fall within the broad scope of the appended claims.

What is claimed is:

1. A golf training device comprising:

a body having a cylinder section including a first end and a second end opposite said first end, said cylinder section defining an interior portion extending from said first end to said second end;

a flange section coupled to said cylinder section proximate said second end; said flange section configured as a disc extending radially outward orthogonal from a centerline of the cylinder section a predetermined diameter; said disc including a cavity proximate said second end wherein said cavity is conical shaped;

an edge formed on a perimeter of said disc; and a receiver formed in said interior portion proximate said first end of said cylinder section, said receiver configured to receive an end of a golf club grip, said interior portion configured to contact said golf club grip in a fixed position.

2. The training device according to claim 1, wherein said edge portion is configured to contact a forearm such that said forearm and a centerline of said golf club form an alignment angle; wherein said alignment angle orients a golfer's hands, wrist and forearm with a centerline of a golf club shaft.

3. A method of using a golf training device comprising:

attaching said golf training device to a golf club grip;

gripping said golf club;

contacting an edge of said golf training device with a forearm;

aligning a centerline of said golf club with said forearm;

forming an alignment angle, wherein said alignment angle orients a golfers hands, wrist and forearm with a centerline of a golf club shaft; and indicating an improper alignment angle, wherein said edge of said golf training device no longer contacts said forearm.

4. A method of using a golf training device comprising:

attaching said golf training device to a golf club grip;

gripping said golf club;

contacting an edge of said golf training device with a forearm;

aligning a centerline of said golf club with said forearm;

forming an alignment angle, wherein said alignment angle orients a golfers hands, wrist and forearm with a centerline of a golf club shaft; and varying said alignment angle, wherein a diameter of a flange section of said golf training device is changed, to result in a different alignment angle.

* * * * *